US008007008B2

(12) United States Patent
Skirbe

(10) Patent No.: US 8,007,008 B2
(45) Date of Patent: Aug. 30, 2011

(54) FOLDABLE MEDIA HOLDER AND RELATED METHOD FOR BLOCKING WIND

(76) Inventor: Frank Skirbe, Huntington, NY (US)

( * ) Notice: Subject to any disclaimer, the term of this patent is extended or adjusted under 35 U.S.C. 154(b) by 791 days.

(21) Appl. No.: 12/011,511

(22) Filed: Jan. 28, 2008

(65) Prior Publication Data

US 2009/0189387 A1 Jul. 30, 2009

(51) Int. Cl.
*B42D 3/00* (2006.01)

(52) U.S. Cl. ..... 281/49

(58) Field of Classification Search ..... 281/45, 281/49, 46–47

See application file for complete search history.

(56) References Cited

U.S. PATENT DOCUMENTS

| | | | | | |
|---|---|---|---|---|---|
| 1,270,611 | A | | 6/1918 | Gay | |
| 1,376,799 | A | * | 5/1921 | Crump | 281/49 |
| 1,565,791 | A | | 12/1925 | Chalfant | |
| 3,065,565 | A | * | 11/1962 | Goodman | 248/451 |
| 3,174,493 | A | | 3/1965 | Gruenberg | |
| 4,506,688 | A | | 3/1985 | Bethoon et al. | |
| 4,593,934 | A | | 6/1986 | Lehman | |
| 4,739,784 | A | | 4/1988 | Fast | |
| 4,861,073 | A | | 8/1989 | Poretsky | |
| 4,966,181 | A | | 10/1990 | Liberman et al. | |
| 5,067,748 | A | * | 11/1991 | Wernquest | 281/48 |
| 5,590,674 | A | | 1/1997 | Eppenbach | |
| 6,355,335 | B1 | | 3/2002 | Kulkaski | |
| 6,360,927 | B1 | | 3/2002 | Barker | |
| 6,449,147 | B2 | | 9/2002 | Zheng | |
| 7,182,042 | B1 | | 2/2007 | Anderson | |
| 2002/0124877 | A1 | | 9/2002 | Dufort | |
| 2006/0157630 | A1 | * | 7/2006 | Buote | 248/441.1 |
| 2006/0251469 | A1 | | 11/2006 | McBride | |

* cited by examiner

*Primary Examiner* — Shelley Self
*Assistant Examiner* — Matthew G Katcoff
(74) *Attorney, Agent, or Firm* — Carter, DeLuca, Farrell & Schmidt, LLP; Russell S. Salerno

(57) ABSTRACT

A foldable media holder for blocking wind includes a foldable frame and a flexible sheeted material. The foldable frame has an erect configuration and a folded configuration and the flexible sheeted material is attached to the foldable frame. The foldable frame includes first, second, third, fourth, and central elongated support members, each having first and second ends. The first and second elongated support members have first and second pivots, respectively. The first end of the central elongated support member is operatively connected to first end of the first elongated support member and the second end of the central elongated support member is operatively connected to the first end of the second elongated support member. When the foldable frame is in the erect configuration the central elongated support member is positioned substantially parallel to the third and fourth elongated support members and is about centrally positioned therebetween.

13 Claims, 7 Drawing Sheets

FOLDABLE MEDIA HOLDER AND RELATED METHOD FOR BLOCKING WIND

BACKGROUND

1. Technical Field

The present disclosure relates to a media holder, and, in particular, to a foldable media holder and related method for blocking wind.

2. Description of Related Art

Outdoor leisure time is scarce for certain portions of the population. Although the demands of modern commerce and the reduction of outdoor recreational spaces have reduced recreational opportunities in certain locations, the general population continues to use their leisure time outdoors reading media in breezy areas. Large portions of the population are flocking to beaches and other breezy areas to read books, newspapers, magazines, and the like for recreation and/or to read about current events.

Normally, comfortable reading requires minimal distractions from the wind. Without adequate wind protection, a person's enjoyment of the outdoors may be diminished greatly. One common cause of discomfort while reading on the beach or other outdoor location is the wind's blowing of pages making it more difficult to hold up the media for reading, e.g., holding up a newspaper is very difficult in strong winds. However, winds can also increase outdoor enjoyment by keeping the reader cool.

Winds vary greatly by region. According to The National Oceanic and Atmospheric Administration (NOAA), some of the mean wind speeds recorded in various regions are shown in Table 1 below.

TABLE 1

| State | Location | Recorded Mean Wind Speed |
|---|---|---|
| New York | Islip | 9 to 10 mph |
| | JFK airport | 11 to 13 mph |
| New Jersey | Atlantic City | 8 to 12 mph |
| North Carolina | Cape Hatteras | 10 to 12 mph |
| | Wilmington | 8 to 10 mph |
| Connecticut | Bridgeport | 10 to 13 |
| Florida | Daytona beach | 7 to 10 mph |
| | Jacksonville | 7 to 9 mph |
| | Key West | 10 to 12 mph |
| | Miami | 8 to 11 mph |
| | Pensacola | 9 to 11 mph |
| | Tampa | 7 to 9 mph |
| | W. Palm | 8 to 11 mph |
| Hawaii | Barbers Point | 9 to 10 mph |
| | Kaneohe Bay | 9 to 12 mph |
| | Honolulu | 11 to 13 mph |
| | Kahului | 13 to 17 mph |
| | Lihue | 11 to 14 mph |
| | Pearl Harbor | 10 to 13 mph |
| Illinois | Chicago | 9 to 12 mph |
| Maine | Bangor | 7 to 9 mph |
| | Portland | 8 to 9 mph |
| Maryland | Baltimore | 8 to 11 mph |
| Massachusetts | Boston | 11 to 14 mph |
| | Falmouth | 8 to 12 mph |
| | Milton/Blue Hill | 13 to 17 mph |
| Rhode Island | Providence | 9 to 12 mph |
| | Quonset Point | 8 to 12 mph |
| South Carolina | Charleston | 8 to 10 mph |
| | Myrtle Beach | 3 to 7 mph |
| Texas | Corpus Christi | 10 to 14 mph |
| | Galveston | 9 tp 12 mph |
| Virginia | Norfolk | 9 to 12 mph |
| Washington | Seattle | 8 to 10 mph |

However, not all types of media are affected equally by the wind. Books with hard outer coverings are easier to grasps than newspapers; and several pages of the book may simply be held between several fingers and a thumb. The fingers can grasp onto the hard book covering while the thumb may hold open the current page. The rigid covers provide some support for the pages and thus mitigate some of the wind's undesired effects. However, because of a book's relative small dimensions, wind may still affect the pages.

Newspapers tend to be larger, less rigid and contain thinner pages than books. Additionally, the pages are not usually bound together to the same extent as books. The lightweight thin pages, large surface area, and the lack of a binding, makes newspapers especially susceptible to high winds. There is a need to assist in supporting newspapers with something other than the reader's hands. Also, using only hands to hold media can be a tiring experience. Because of age or illness, wind may also cause certain readers additional difficulties in supporting a newspaper for prolonged periods of time.

Thus, a cheap, light, and compact media holder is needed by the average person while reading outdoors. The media holder should also double as a wind barrier as well. The media holder should be lightweight, collapsible, and supported by an appropriate support structure. A person taking trips outdoors should also not be burdened by heavy, clumsy, or non-portable contraptions. Thus, there is a need for a lightweight, easily foldable, media holder for transporting to and from outdoor areas that can sufficiently block wind.

SUMMARY

The present disclosure relates to a media holder, and, in particular, to a foldable media holder and related method for blocking wind. In one aspect of the present disclosure, a foldable media holder for blocking wind includes a foldable frame and a flexible sheeted material. The foldable frame has an erect configuration and a folded configuration. The foldable frame includes first, second, third, fourth and central elongated support members, which may be dimensioned for holding a newspaper. The first elongated support member has a first pivot defining first and second ends, and the second elongated support member has a second pivot defining first and second ends. When the foldable frame is in the erect configuration, the second elongated support member is substantially parallel to the first elongated support member defining a planar area.

The third elongated support member also has first and second ends. The first end of the third elongated support member is operatively connected to the first end of the first elongated support member; and the second end of the third elongated support member is operatively connected to the first end of the second elongated support member. The fourth elongated support member has first and second ends. The first end of the fourth elongated support member is operatively connected to the second end of the first elongated support member; and the second end of the fourth elongated support member is operatively connected to the second end of the second support member. When the foldable frame is in the erect configuration the fourth elongated support member is substantially parallel to the third elongated support member.

The central elongated support member has first and second ends. The first end of the central elongated support member is operatively connected to first end of the first elongated support member; and the second end of the central elongated support member is operatively connected to the first end of the second elongated support member. When the foldable frame is in the erect configuration, the central elongated support member is positioned substantially parallel to the third and fourth elongated support members and is about centrally positioned therebetween. The central elongated support member may include one or more clipping members attached thereto that are configured to secure media.

The flexible sheeted material is attached to one or more of the first, second, third and fourth elongated support member; and when the frame is in the erect configuration the flexible sheeted material is substantially parallel to the planar area, e.g., the flexible sheeted material may be connected to all four elongated support members and is "stretched out" when the foldable frame is in the erect configuration. Additionally or alternatively, the flexible sheeted material may be attached to the central elongated support member as well.

The first and second pivots may define a first folding axis. The first folding axis may be adjacent to the central elongated support member and may be configured for preventing the third and fourth elongated support members from contacting when folding the foldable frame along the first folding axis.

In another aspect of the present disclosure, the first or second pivots may be a living hinge. Living hinges are thin sections of plastic (or other material) that connect two segments of a part to keep them together and allow the parts to pivotable relative to each other. Additionally or alternatively, one of the elongated support members may define a longitudinal axis, a first plane, and a second plane. The first plane is parallel to the longitudinal axis and intersects a pivot; the second plane is perpendicular to the longitudinal axis and intersects the pivot. The pivot extends outwards from the first plane, and the pivot at least partially slopes convexly parallel to the first plane towards the second plane.

In another aspect of the present disclosure, the third elongated support member includes a third pivot pivotally connecting the first and second ends of the third elongated support member. The fourth elongated support member includes a fourth pivot pivotally connecting the first and second ends of the fourth elongated support member. And the central elongated support member includes a fifth pivot pivotally connecting the first and second ends of the fourth elongated support member.

In another aspect of the present disclosure, one of the elongated support members is substantially cylindrically shaped. The foldable frame further include a hollow slider having an inside dimensionally configured to concentrically surround the elongated support member. The foldable media holder may further include first and second travel slider stops on the outside surface of the elongated member. The first travel slider stop is positioned to lock the pivot of the elongated support member whereby facilitating the erect configuration of the foldable frame, and the second travel slider stop is positioned to facilitate pivoting of the pivot whereby facilitating the folded configuration of the foldable frame.

In another aspect of the present disclosure, one of the elongated support members has a substantially H-shaped cross-section. The foldable frame may include a hollow slider having an inside dimensionally configured to substantially surround the elongated support member. Additionally or alternatively, the foldable frame includes a means for locking the pivot of the elongated support member.

In yet another aspect of the present disclosure, the first elongated support member has a substantially C-shaped cross-section and the foldable frame further includes a hollow slider having an inside dimensionally configured to substantially surround the first elongated support member. Additionally or alternatively, the foldable frame may further include a means for locking the first pivot of the first elongated support member.

In another aspect of the present disclosure, the central elongated support member has a substantially U-shaped cross-section along a substantial portion thereof. The foldable media holder may include an attachable elongated holder bar. The holder bar may have first and second snap-on securing members positioned on opposite ends thereof that are dimensioned to snap-on to the central elongated support member and/or is configured to secure media to the foldable media holder.

In one embodiment, the attachable elongated holder bar may have first and second metallic members at opposite ends thereof while the attachable elongated holder bar has first and second magnetic members positioned on opposite ends thereof. The first and second magnetic members are positioned to magnetically attach to the central elongated support member thus securing media to the foldable media holder.

In yet another aspect of the present disclosure, the foldable frame includes an elongated accessory attachment member having first and second ends. The first end of the elongated accessory attachment member may be operatively connected to the first, second, third, or fourth elongated support members. A c-clamp may be operatively connected to the second end of the elongated accessory attachment member. Additionally or alternatively, the elongated accessory attachment member may be configured to operatively connect to one or more of the following: a chair, an umbrella, a table, or a car window.

In another aspect of the present disclosure, a method for blocking wind to read media is provided herein. The method includes providing a foldable media holder for blocking wind and securing the media to the foldable media holder. The foldable media holder of the method may be an embodiment disclosed herein. The method may include folding the frame along the first folding axis as disclosed supra and also as discussed in more detailed below.

In another aspect of the present disclosure, a foldable media holder for blocking wind includes a support means for supporting flexible sheeted material, a folding means for folding the flexible sheeted material, a locking means for holding the flexible sheeted material erect, and a securing means for securing the media.

BRIEF DESCRIPTION OF THE DRAWINGS

These and other advantages will become more apparent from the following detailed description of the various embodiments of the present disclosure with reference to the drawings wherein.

DETAILED DESCRIPTION

Figure 1:
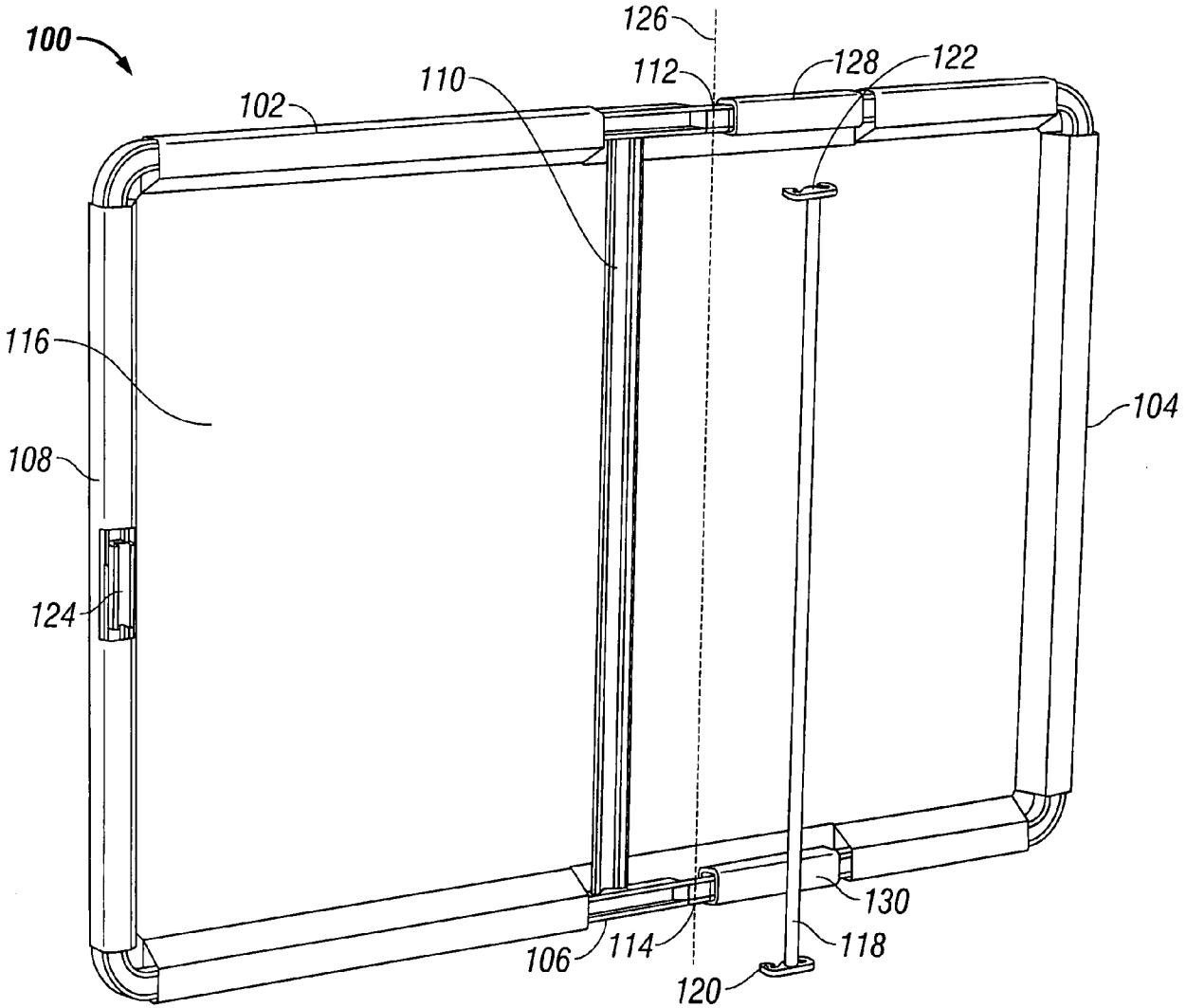
FIG. 1 is a perspective view of an embodiment of a foldable media holder having one folding axis and an attachable elongated holder bar in accordance with the present disclosure.

Referring to the drawings, FIG. 1 is a perspective view of foldable media holder 100. Foldable media holder 100 is shown in the erect configuration and includes elongated support members 102, 104, 106, and 108. Central elongated support member 110 is connected to elongated support members 102 and 106. Elongated support members 102, 104, 106, and 108 and central elongated support member 110 together form the frame of foldable media holder 100. Elongated support member 102 includes pivot 112 and elongated support member 104 includes pivot 112. Pivots 112 and 114 may be a living hinge. Flexible sheeted material 116 is shown and is connected to elongated support members 102, 104, 106, and 108. When foldable media holder 100 is in the erect configuration, flexible sheeted material 116 may be stretched thus assisting in the wind blocking capability.

Central elongated support member 110 has a substantially u-shaped cross-section. The u-shape of central elongated support member 110 assists in mechanically securing media for reading. Foldable media holder 100 also includes attachable elongated holder bar 118 that includes snap-on securing members 120 and 122 located on opposite ends thereof. Each of snap-on securing members 120 and 122 is configured to secure the attachable elongated holder bar 118 to the central elongated support member 110. For example, a newspaper may be opened and attachable elongated holder bar 118 can be placed within the opened pages; then the user of the device can snap-on the snap-on securing members 120 and 122 onto elongated support member 106 thus securing the newspaper for reading. In another embodiment contemplated, the attachable elongated holder bar is magnetically connected to the central elongated support member. The snap-on action is discussed in more detail below with reference to FIG. 2. In yet another embodiment, attachable elongated holder bar 118 may be replaced with a bungee cord, a flexible cord, a rubber cord, other elastic-material based cord, and/or the like.

However, when foldable media holder 100 is being transported in either the folded or the erect configuration, attachable elongated holder bar 118 may be held by holder 124. Holder 124 is designed to ensure that attachable elongated holder bar can be pressed into a receiving area and held into place by the elasticity of the material.

As mentioned above, foldable media holder 100 has a folded configuration and an erect configuration. FIG. 1 shows foldable media holder 100 in the erect configuration. Foldable media holder 100 may be folded along axis 126 defined by pivots 112 and 114. However, elongated support members 102 and 106 are not shown as being locked. Pivot 112 may be locked by moving hollow slider 128 over pivot 112, thus locking pivot 112. Additionally, hollow slider 130 can be moved over pivot 114, thus locking pivot 114 as well. Note that elongated support members 102 and 106 have an H-shaped cross section and that hollow sliders 128 and 130 have an inside dimensioned to substantially concentrically surround elongated support members 102 and 106, respectively.

Figure 2:
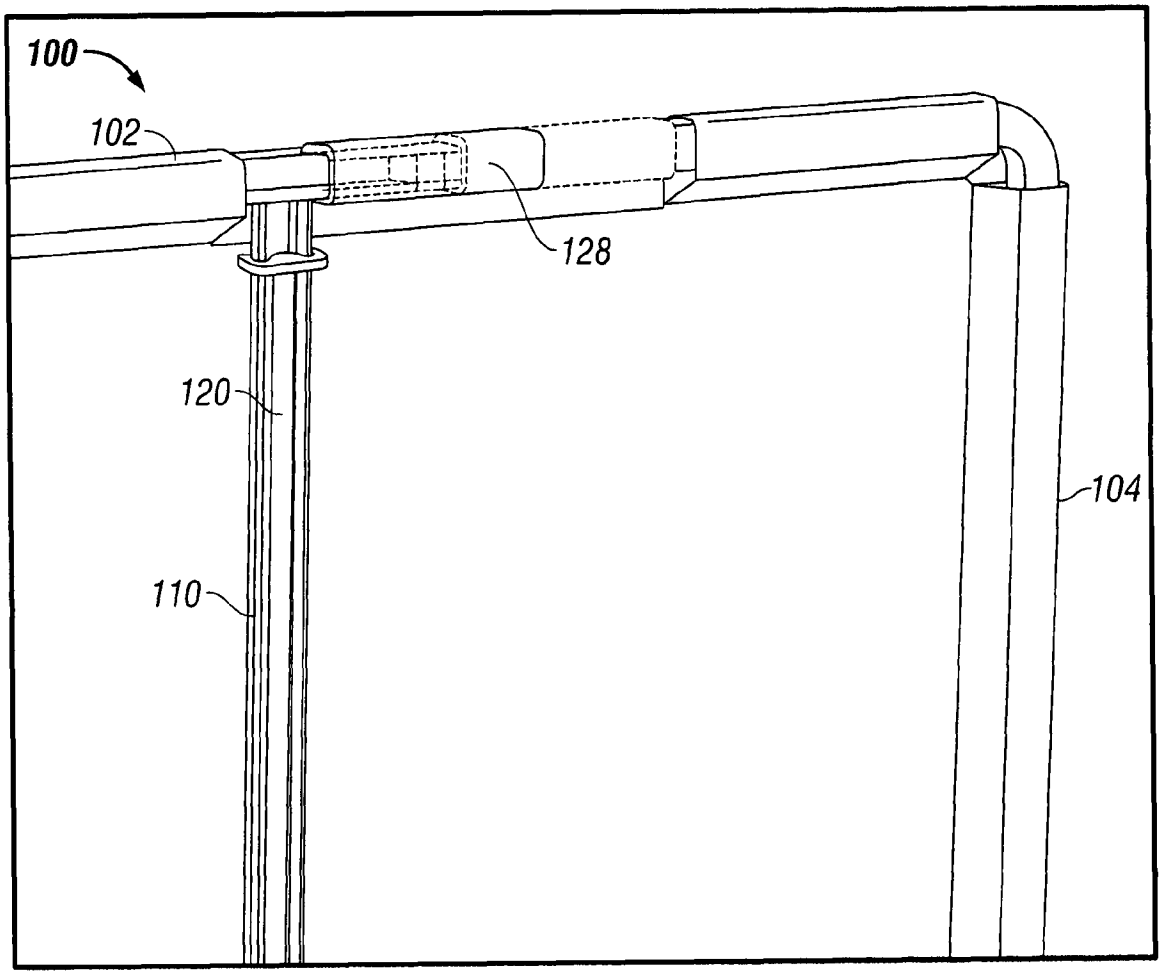
FIG. 2 is a close-up perspective view of a portion of FIG. 1 that includes a close-up view of a pivot in accordance with the present disclosure.
Figure 3:
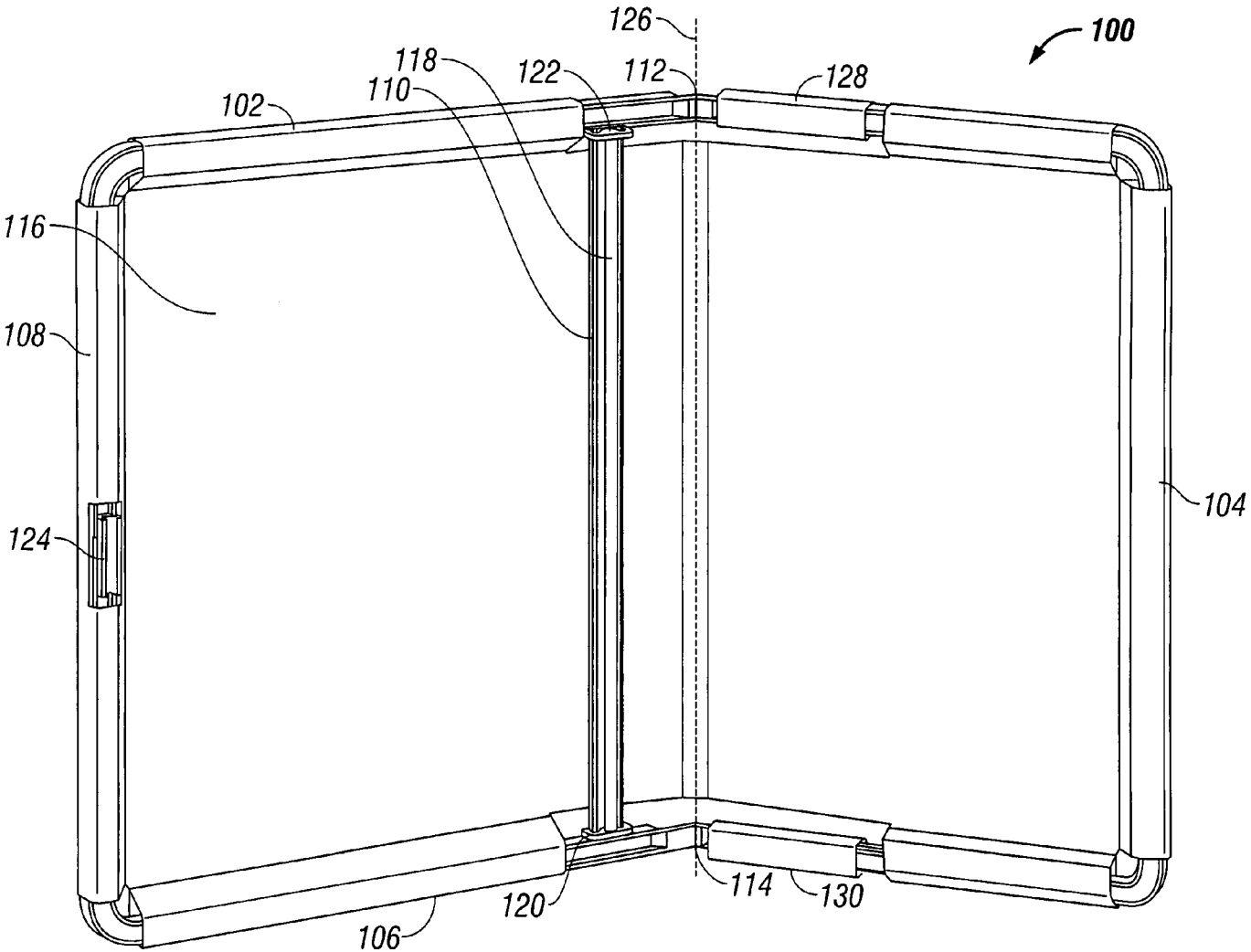
FIG. 3 is a perspective view of the foldable media holder of FIG. 1 partially folded along the folding axis in accordance with the present disclosure.

Referring to the drawings, FIG. 2 shows a close-up view of a portion of foldable media holder 100 that is also shown in FIGS. 1-3. FIG. 2 illustrates the "snap-on" action of snap-on securing member 120 that can secure media, such as a newspaper, for reading by the user. Also, note that hollow slider 128 is shown as locking pivot 112, thus partially showing the erect configuration of foldable media holder 100. However, in another embodiment (not shown) and as mentioned above, snap-on securing member 120 may be replaced with a bungee cord, a flexible cord, a rubber cord, other elastic-material based cord, and/or the like.

Referring to the drawings, FIG. 3 shows foldable media holder with hollow sliders 128 and 130 as not locking pivots 112 and 114, respectively. Additionally, FIG. 3 shows foldable media holder 100 as partially folded along axis 126. Note that axis 126 is not exactly half-way between elongated support members 104 and 108, thus, when foldable media holder is fully folded along axis 112, elongated support members 104 and 108 do not contact each other when fully folded.

Referring simultaneously to FIGS. 1, 2, and 3, foldable media holder 100 has a frame that includes elongated supports members 102, 104, 106 and 108, central elongated support member 110, and attachable elongated holder bar 118 that may be made from wood, metal, plastic, a polymer, or the like; additionally or alternatively, the components may be made utilizing injection molding. Flexible sheeted material 116 may be made from any flexible, tear-resistant material such as a polymer, canvas, a flexible rubber, Tyvec, and/or the like. For example, flexible sheeted material 116 may be made from North 1.5 oz. ripstop Grade A.

Figure 4:
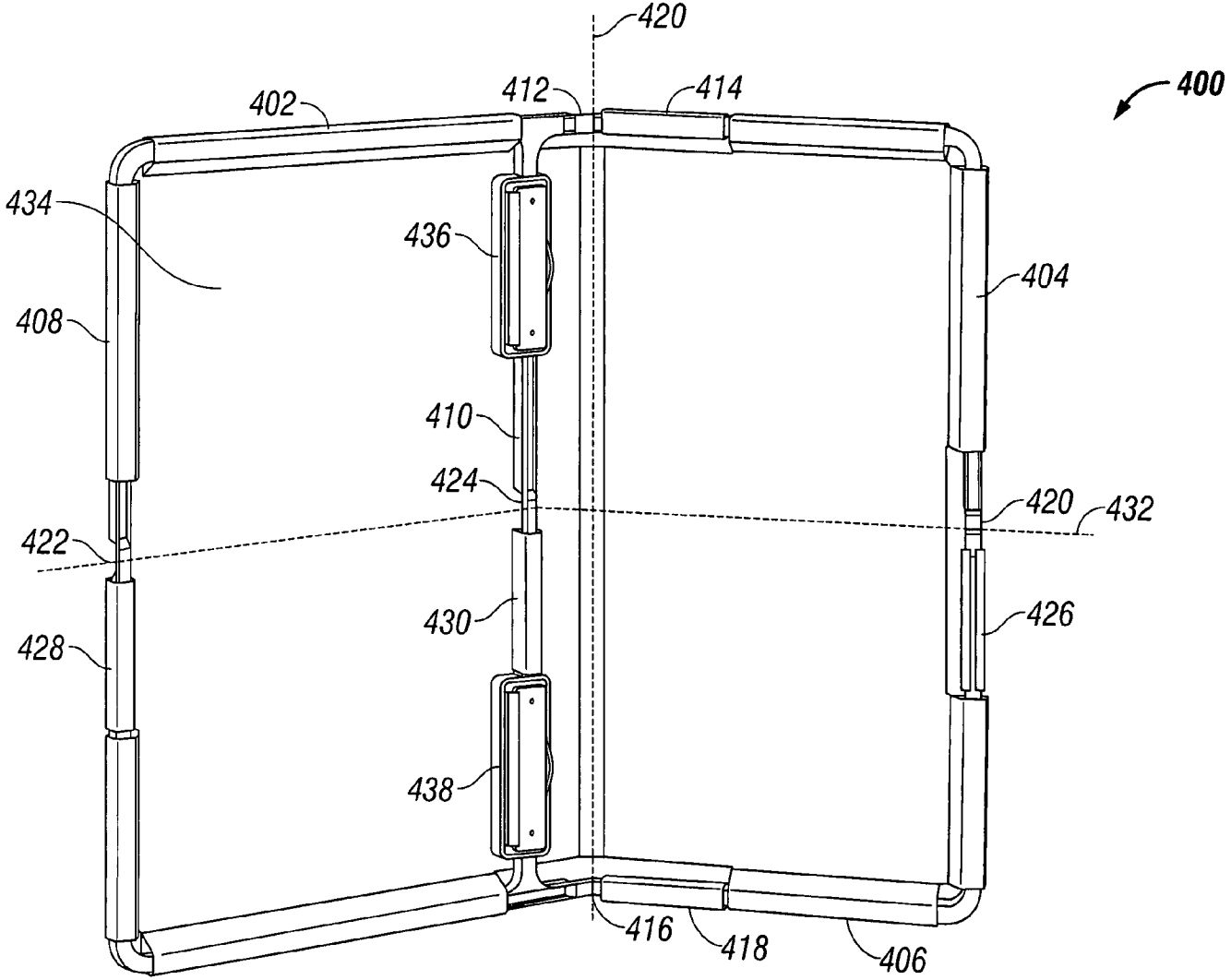
FIG. 4 is a perspective view of an embodiment of a foldable media holder having two folding axis and two clipping members attached to a central elongated support member in accordance with the present disclosure.

Referring to the drawings, FIG. 4 shows another embodiment of a foldable media holder in accordance with the present disclosure. Foldable media holder 400 is shown and has a frame that includes elongated support members 402, 404, 406, and 408, and central elongated support member 410. Elongated support member 402 has pivot 412 that can be locked by hollow slider 414. Elongated support member 406 has pivot 416 that may be locked by hollow slider 418. Pivots 412 and 416 define an axis 420 in which foldable media holder 400 may be folded.

Figure 5:
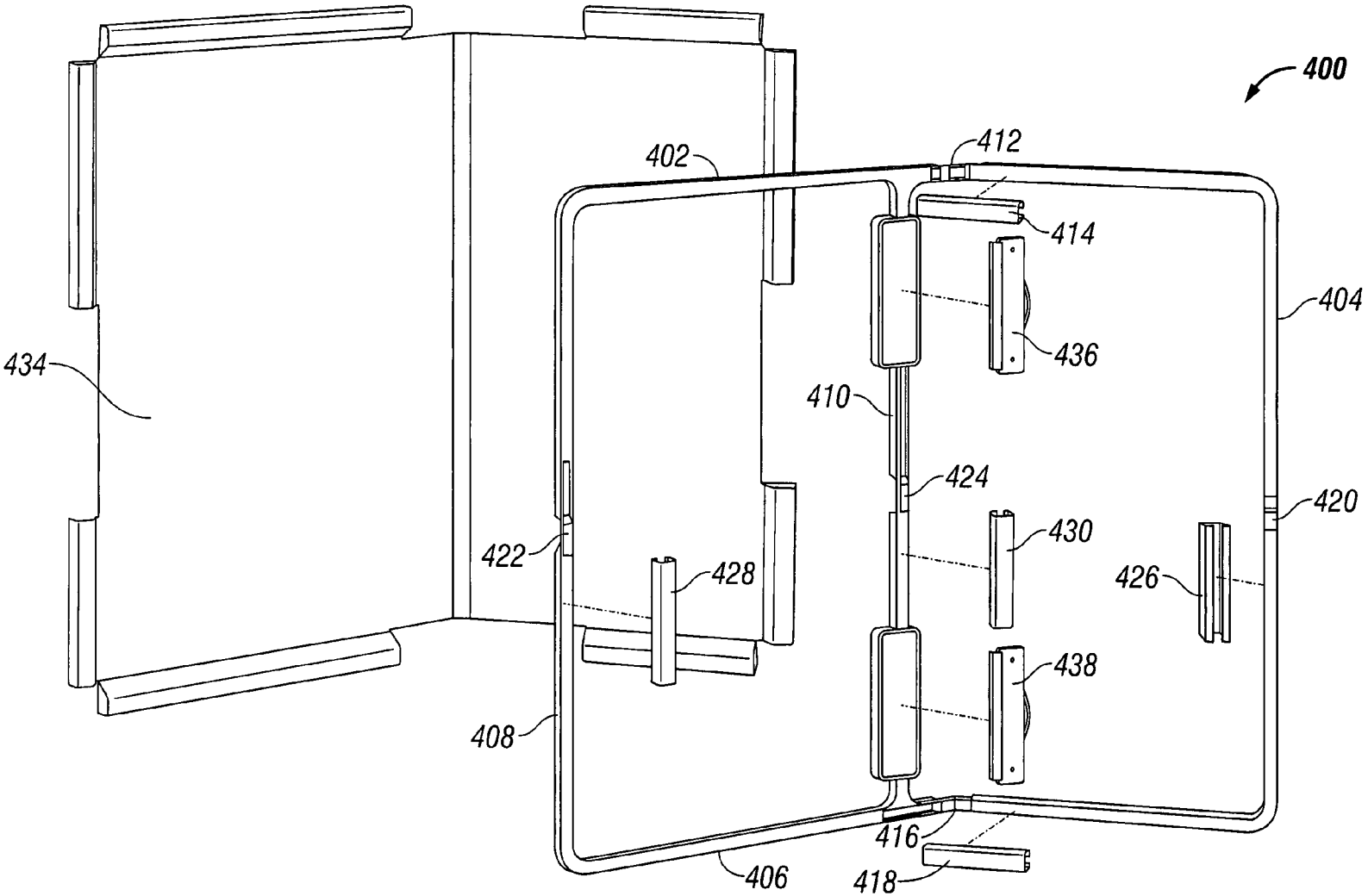
FIG. 5 is a exploded view of the foldable media holder of FIG. 4 in accordance with the present disclosure.

Additionally, elongated support members 404 and 408, and central elongated support member 410 each have a pivot, i.e. pivots 420, 422 and 424, respectively. Pivot 420 is lockable by hollow slider 426; pivot 422 is lockable by hollow slider 428; and pivot 424 is lockable by hollow slider 430. Pivots 420, 422, and 424 define axis 432. Foldable media holder 400 may be initially folded along axis 420 and thereafter, further folded along axis 432, placing foldable media holder 100 in a folded configuration. Compare the dual folding axes of foldable media holder 400 as shown in FIGS. 4 and 5 to the single folding axis of foldable media holder 100 as shown in FIGS. 1-3. The choice of using a dual folding axes foldable media holder as compared to using a single folding axis foldable media holder depends on several factors, including, the size of the media to be held, the type of media to be held (e.g. paper tabloid, magazine, etc.), the position the media's crease for folding, the portability desired, the cost of manufacturer, and the like. Additionally, the cost of flexible sheeted material 434 may be considered.

Foldable media holder 400 includes clipping members 436 and 438 for securing media, such as a newspaper. Clipping members 436 and 438 may include a torsion spring attached to a securing bar to secure the media. Additionally, the securing bar may include materials to increase the friction, and thus the effectiveness, of securing media to the device.

Foldable media holder 400 is shown in exploded view in FIG. 5 to illustrate that many of the parts may be made from a single mold used in an injection molding process, thus reducing manufacturing costs. Injection molding may use thermoplastic and/or thermosetting plastic materials. The most commonly used thermoplastic materials are polystyrenes, co-polymers, e.g., acrylonitrile butadiene styrene, nylon, polypropylene, polyethylene, polyvinyl chloride, and the like. As illustrated in FIG. 5, elongated support members 402, 404, 406 and 408, and central elongated support member 410 all may be made from a single "mold" used in an injection molding process because the majority of the parts are connected. Additionally, pivots 412, 420, 416, 422, and 424 are all, in this embodiment, living hinges and are thus easily manufactured during an injection molding process. A single mold process may be used and/or foldable media holder 500 may be partially molded and partially assembled.

Referring to FIG. 1-5, although foldable media holders 100 and 400 are shown having multiple elongated support members with an H-shaped cross section, it is contemplated in other embodiments that the elongated support members be substantially cylindrically shaped, such as a hollow tube with or without internal support by members. Additionally or alternatively, foldable media holders 100 and 400 may include one or more elongated support members with a C-shaped cross section with or without support members. One type of support member is referred to as a "support rib", similar to the internal support ribs found in aircraft wings.

Additionally or alternatively, although foldable media holders 100 and 400 are shown as having multiple living hinges as pivots, it is contemplated that a yoke and pin assembly be used to provide the pivots of the respective pivotable elongated support members. For example, pivot 112 of FIG. 1 of foldable media holder 100 may use a yoke a pin assembly to facilitate elongated support member 102 to be pivotable along axis 126, as an alternative to as shown in FIG. 1

Figure 6A:
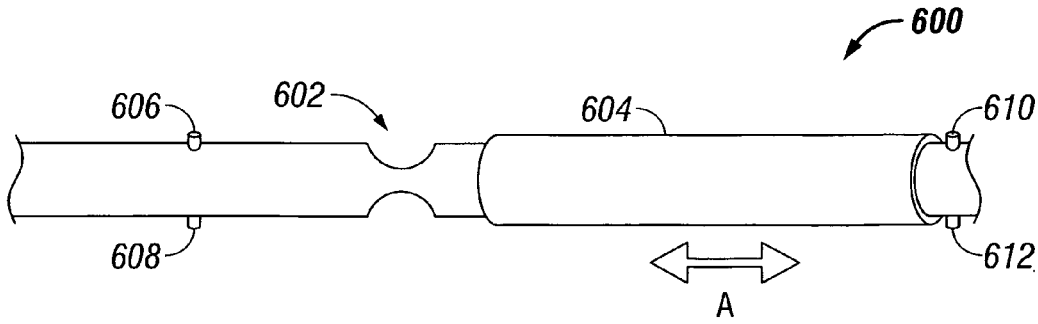
FIG. 6*a* is a close-up perspective view of a substantially cylindrically shaped elongated support member having a pivot and a hollow slider with an inside dimensioned to concentrically surround the elongated support member in accordance with the present disclosure.

Referring to the drawings, FIG. 6*a* shows a close-up view of a portion of elongated support member 600 with pivot 602. Elongated support member 600 may be part of an embodiment of a foldable media holder. Elongated support member 600 is substantially cylindrically shaped and can be pivoted along pivot 602. Hollow slider 604 has an inside dimensionally configured to concentrically surround elongated support member 604. Arrows "A" illustrates the directions that hollow slider 604 may travel. However, the movement of hollow slider 604 is curtailed by travel slider stops 606, 608, 610, and 612.

Travel slider stops 610 and 612 are positioned to stop hollow slider 604 from sliding too far away from pivot 602, thus facilitating the user in finding the travel slider stop to lock pivot 602, e.g., when changing the foldable media holder from the folded configuration to the erect configuration. Travel slider stops 606 and 608 are positioned to properly position hollow slider 604 over pivot 602 in a locked position, thus facilitating the erect configuration of the foldable media holder.

Figure 6B:
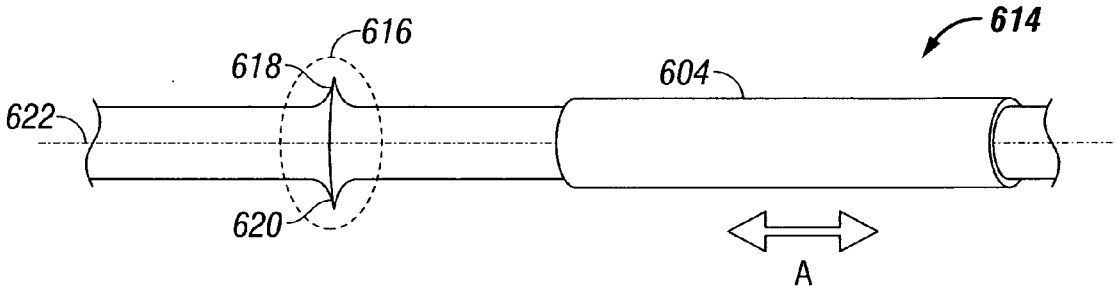
FIG. 6*b* is a top-view of a living hinge assembly including a pinched hinge region and a hollow slider with an inside dimensioned to concentrically surround the elongated support member in accordance with the present disclosure.
Figure 6C:
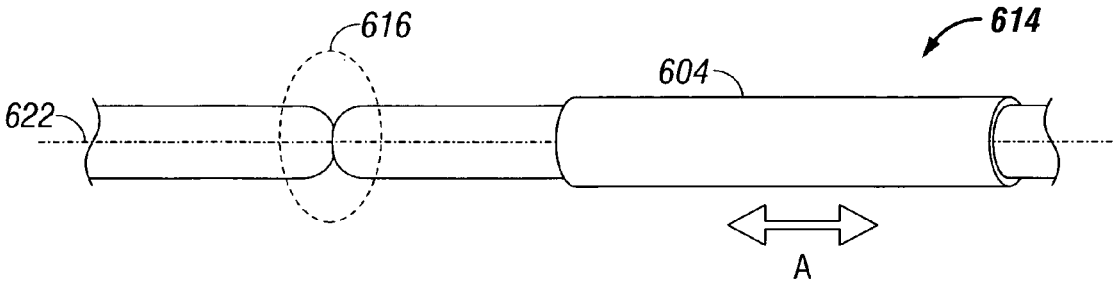
FIG. 6*c* is a side-view of the living hinge assembly of FIG. 6*b* in accordance with the present disclosure.

Referring to the drawings, FIGS. 6*b* and 6*c* show a top-view and a side-view of living hinge assembly 614, respectively. Living hinge assembly 614 includes pinched hinge region 616 that includes protrusions 618 and 620 that protrude from axis 622. Protrusions 618 and 620 are dimensioned to frictionally lock hollow slider 604 when hollow slider 604 is positioned to surround pinched hinge region 616. A friction lock prevents hollow slider 604 from moving along the directions as indicated by Arrows A unless a threshold force is applied along one of the directions indicated by arrows A. Once the threshold force is applied, hollow slider 604 may be moved. Referring now to the FIG. 6*c*, pinched hinge region 616 is shown from a side view. Note that the dimensions of pinched hinge region 616 allows living hinge assembly 614 to pivot. Living hinge assembly 614 may be pivots 112 and/or 114 of FIGS. 1 through 3; or may be pivots 412, 416, 420, 422, and/or 424 of FIGS. 4 and 5.

Figure 7:
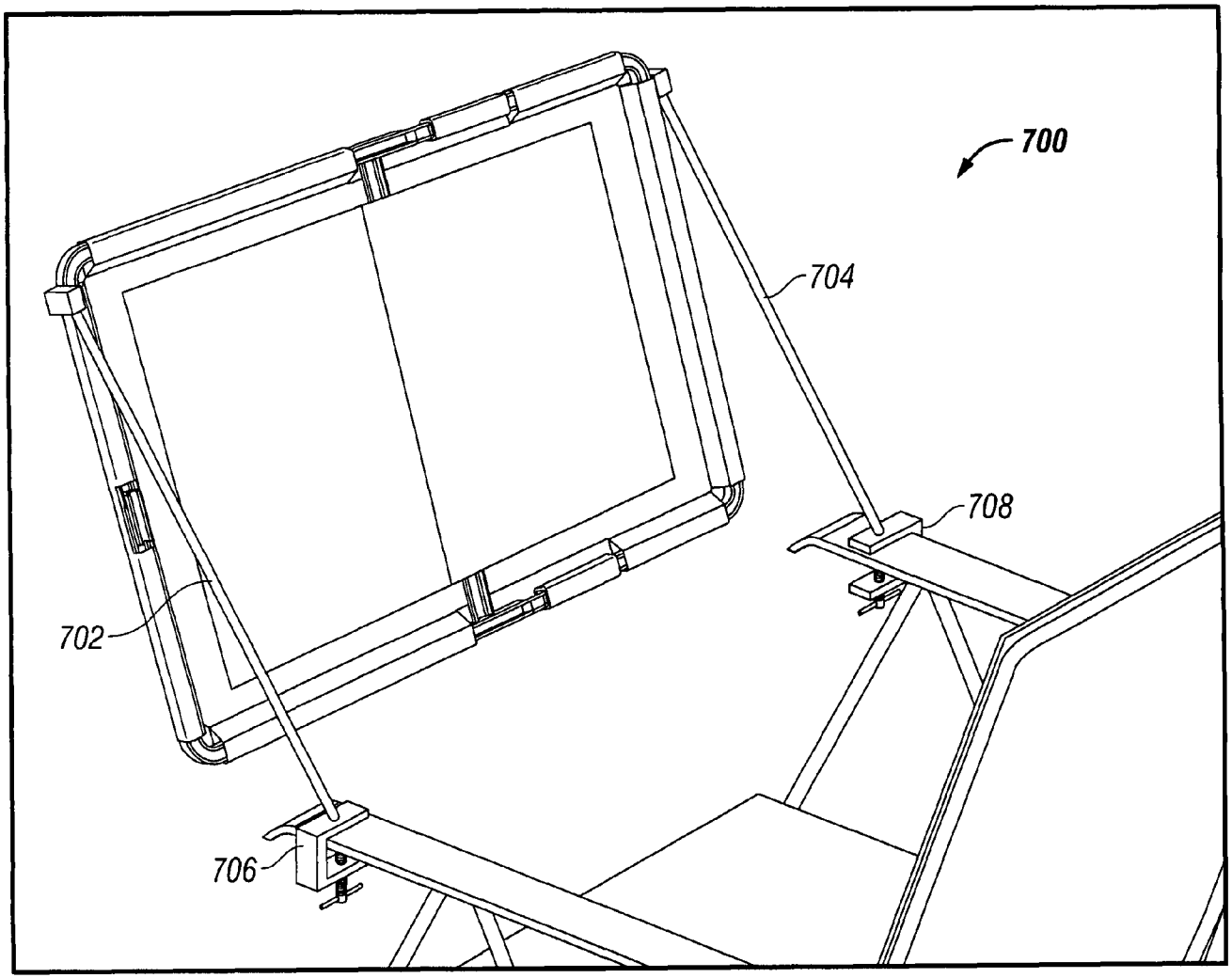
FIG. 7 is a perspective view of a foldable media holding that includes two elongated accessory attachment members attached to a chair via c-clamps in accordance with the present disclosure.

Referring to the drawings, FIG. 7 shows a perspective view of foldable media holder 700. Foldable media holder 700 includes accessory attachment members 702 and 704 for attaching to a chair. Accessory attachment member 702 has one end attached to the frame of foldable media holder 700 and the other end has c-clamp 706. C-clamp 706 is shown as attached to a chair. Additionally, accessory attachment member 704 has one end attached to the frame of foldable media holder 700 with the opposite end attached to c-clamp 708. C-clamp 708 is also attached to the chair. Accessory attachment members 702 and 704 may be configured to attach to other devices as well. For example, accessory attachment members 702 and 704 may be designed to attach foldable media holder 700 to a chair, an umbrella, a table and/or a car window.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A foldable media holder for blocking wind, comprising:

a foldable frame having an erect configuration and a folded configuration, the foldable frame comprising:

a first elongated support member having a first portion and a second portion, each portion having a hinge end and an opposing end, wherein the first elongated support member is foldable about a first living hinge assembly disposed between the first portion and the second portion thereof;

a second elongated support member having a first portion and a second portion, each portion having a hinge end and an opposing end, wherein the second elongated support member is foldable about a second living hinge assembly disposed between the first portion and the second portion thereof, wherein the hinge axis of the first living hinge assembly is in substantial alignment with the hinge axis of the second living hinge thereby defining a first folding axis;

a third elongated support member having a first portion and a second portion, each portion having a hinge end and an opposing end, wherein the third elongated support member is foldable about a third living hinge assembly disposed between the first portion and the second portion thereof, wherein the opposing end of the first portion of the third elongated support member is fixed to the opposing end of the first portion of the first elongated support member, and the opposing end of the second portion of the third elongated support member is fixed to the opposing end of the first portion of the second elongated support member;

a fourth elongated support member having a first portion and a second portion, each portion having a hinge end and an opposing end, wherein the fourth elongated support member is foldable about a fourth living hinge assembly disposed between the first portion and the second portion thereof, wherein the opposing end of the first portion of the fourth elongated support member is fixed to the opposing end of the second portion of the first elongated support member, and the opposing end of the second portion of the fourth elongated support member is fixed to the opposing end of the second portion of the second support member; and a central elongated support member having a first portion and a second portion, each portion having a hinge end and an opposing end, wherein the central elongated support member is foldable about a fifth living hinge assembly disposed between the first portion and the second portion thereof, wherein the opposing end of the first portion of the central elongated support member is fixed to the hinge end of the first portion of the first elongated support member, and the opposing end of the second portion of the central elongated support member is fixed to the hinge end of the first portion of the second elongated support member, wherein the hinge axis of the third living hinge assembly, the fourth living hinge assembly, and the fifth living hinge assembly are in substantial alignment thereby defining a second folding axis orthogonal to the first folding axis;

wherein when the foldable frame is in the erect configuration the elongated support members defining a substantially planar area;

a flexible sheeted material attached to at least one of the first, second, third and fourth elongated support members, wherein when the frame is in the erect configuration the flexible sheeted material is substantially parallel to the planar area wherein at least one of the first living hinge, second living hinge, third living hinge, fourth living hinge, or fifth living hinge comprises:

first and second tubular hinge members;

a tubular locking member having an inner diameter dimensionally configured to concentrically surround the first and second tubular hinge members; and a pinched hinge region attaching the first tubular body to the second tubular body, the hinge region having a hinge axis and having a lateral protrusion extending bilaterally from the hinge axis dimensioned to frictionally engage the hollow slider when the first and second tubular hinge members are substantially axially aligned.

2. The foldable media holder according to claim 1, wherein the first elongated support member is substantially cylindrically shaped.

3. The foldable media holder according to claim 1, wherein the first elongated support member has a substantially H-shaped cross-section.

4. The foldable media holder according to claim 1, wherein the first elongated support member has a substantially C-shaped cross-section.

5. The foldable media holder according to claim 1, wherein the central elongated support member includes at least one clipping member attached thereto, wherein the at least one clipping member is configured to secure media.

6. The foldable medial holder according to claim 5, wherein the clipping member further comprises an attachable elongated holder bar having first and second snap-on securing members positioned on opposite ends thereof, wherein the first and second snap-on securing members are dimensioned to the central elongated support member.

7. The foldable media holder according to claim 5, wherein the clipping member further comprises an attachable elongated holder bar having first and second magnetic members positioned on opposite ends thereof, wherein the first and second magnetic member are further positioned to magnetically attach to the central elongated support member.

8. The foldable media holder according to claim 1, the foldable frame further comprising:

an elongated accessory attachment member having first and second ends, wherein the first end of the first elongated accessory attachment member is operatively connected to one of the first, second, third, or fourth elongated support members.

9. The foldable media holder according to claim 8, the foldable frame further comprising:

a c-clamp operatively connected to the second end of the elongated accessory attachment member.

10. The foldable media holder according to claim 8, wherein the elongated accessory attachment member is configured to operatively connect to at least one of a chair, an umbrella, a table, or a car window.

11. The foldable media holder according to claim 1, wherein the first, second, third, and fourth elongated support members are dimensioned for holding a newspaper.

12. A method of blocking wind to read media, comprising:

providing a foldable media holder for blocking wind, comprising:

a first elongated support member having a first portion and a second portion, each portion having a hinge end and an opposing end, wherein the first elongated support member is foldable about a first living hinge assembly disposed between the first portion and the second portion thereof;

a second elongated support member having a first portion and a second portion, each portion having a hinge end and an opposing end, wherein the second elongated support member is foldable about a second living hinge assembly disposed between the first portion and the second portion thereof, wherein the hinge axis of the first living hinge assembly is in substantial alignment with the hinge axis of the second living hinge thereby defining a first folding axis;

a third elongated support member having a first portion and a second portion, each portion having a hinge end and an opposing end, wherein the third elongated support member is foldable about a third living hinge assembly disposed between the first portion and the second portion thereof, wherein the opposing end of the first portion of the third elongated support member is fixed to the opposing end of the first portion of the first elongated support member, and the opposing end of the second portion of the third elongated support member is fixed to the opposing end of the first portion of the second elongated support member;

a fourth elongated support member having a first portion and a second portion, each portion having a hinge end and an opposing end, wherein the fourth elongated support member is foldable about a fourth living hinge assembly disposed between the first portion and the second portion thereof, wherein the opposing end of the first portion of the fourth elongated support member is fixed to the opposing end of the second portion of the first elongated support member, and the opposing end of the second portion of the fourth elongated support member is fixed to the opposing end of the second portion of the second support member; and a central elongated support member having a first portion and a second portion, each portion having a hinge end and an opposing end, wherein the central elongated support member is foldable about a fifth living hinge assembly disposed between the first portion and the second portion thereof, wherein the opposing end of the first portion of the central elongated support member is fixed to the hinge end of the first portion of the first elongated support member, and the opposing end of the second portion of the central elongated support member is fixed to the hinge end of the first portion of the second elongated support member, wherein the hinge axis of the third living hinge assembly, the fourth living hinge assembly, and the fifth living hinge assembly are in substantial alignment thereby defining a second folding axis orthogonal to the first folding axis;

wherein when the foldable frame is in the erect configuration the elongated support members defining a substantially planar area;

a flexible sheeted material attached to at least one of the first, second, third and fourth elongated support members, wherein when the frame is in the erect configuration the flexible sheeted material is substantially parallel to the planar area wherein at least one of the first living hinge, second living hinge, third living hinge, fourth living hinge, or fifth living hinge comprises:

first and second tubular hinge members;

a tubular locking member having an inner diameter dimensionally configured to concentrically surround the first and second tubular hinge members; and a pinched hinge region attaching the first tubular body to the second tubular body, the hinge region having a hinge axis and having a lateral protrusion extending bilaterally from the hinge axis dimensioned to frictionally engage the hollow slider when the first and second tubular hinge members are substantially axially aligned; and securing media to the foldable media holder.

13. The method according to claim 12, wherein the method further comprises the step of:

folding the frame along at least one of the first folding axis or the second folding axis.

* * * * *